US008333630B1

(12) United States Patent
Bedford

(10) Patent No.: US 8,333,630 B1
(45) Date of Patent: Dec. 18, 2012

(54) HARD EDGE FOR INFLATABLE SURFBOARD

(76) Inventor: Steven D. Bedford, Vista, CA (US)

( * ) Notice: Subject to any disclaimer, the term of this patent is extended or adjusted under 35 U.S.C. 154(b) by 0 days.

(21) Appl. No.: 13/536,856

(22) Filed: Jun. 28, 2012

Related U.S. Application Data

(60) Provisional application No. 61/586,025, filed on Jan. 12, 2012.

(51) Int. Cl.
*B63B 35/79* (2006.01)

(52) U.S. Cl. ..... 441/74; 441/79

(58) Field of Classification Search ..... 114/358, 114/345, 123; 441/65, 66, 74, 79
See application file for complete search history.

(56) References Cited

U.S. PATENT DOCUMENTS

| | | | | |
|---|---|---|---|---|
| 3,321,784 | A * | 5/1967 | Rasmussen | 114/343 |
| 3,657,753 | A | 4/1972 | Le Blanc, Sr. | |
| 4,586,451 | A * | 5/1986 | Mori | 114/219 |
| 4,598,659 | A * | 7/1986 | Chinnery | 441/74 |
| 5,174,220 | A * | 12/1992 | Skedeleski et al. | 114/219 |
| 5,483,914 | A * | 1/1996 | Wonka et al. | 114/345 |
| 6,066,016 | A * | 5/2000 | Yonover | 441/40 |
| 6,955,577 | B1 * | 10/2005 | Hall | 441/74 |

* cited by examiner

*Primary Examiner* — Edwin Swinehart
(74) *Attorney, Agent, or Firm* — The Maxham Firm

(57) ABSTRACT

Apparatus for attachment to an inflatable surfboard, which apparatus has a shape and configuration to provide a rigid edge that enables improved surfing performance. The apparatus may be attached to a non-inflatable board to provide an improved rigid edge.

14 Claims, 9 Drawing Sheets

HARD EDGE FOR INFLATABLE SURFBOARD

FIELD OF INVENTION

The present application relates generally to the field of surfboards, boogie boards, and similar devices used for recreation and sport competitions in bodies of water such as oceans or recreation pools with wave generators, and more particularly to inflatable versions of these devices.

BACKGROUND

The sport and recreational activity of surfing gained broad popularity in the 1940's in the United States, Australia, and other countries having coastlines with characteristics that produced large ocean waves incident on the shores. The activity often referred to as "riding the waves" was a common recreational activity. As those engaged in this activity began using solid boards, usually made of wood, to increase the length of time one could "ride" a wave, improvements in the design and construction of such boards were made by the practitioners themselves and later by entrepreneurs investing in developing optimal designs, and manufacturing and selling "surfboards" featuring those designs.

Many designs have emerged over time, beginning with so-called long boards, which ranged from 7 to 14 feet in length and were effective at riding small and large waves because of their stability. In the early 1980's, emphasis shifted to high performance short boards with lengths as short as 5 feet that were more maneuverable and allowed surfers to generate greater speed and perform tricks such as jumps and reverses.

One burden that the sport of surfing with surfboards imposed upon the surfers using them was the difficulty of transporting the surfboards to and from the site of surfing activity. Transporting rigid relatively heavy surfboards with lengths between 5 and 14 feet is awkward at best. Surfboards that could be separated into sections were developed to minimize this burden. Also developed were inflatable surfboards that could be deflated and rolled into a compact package that could easily fit into most vehicles or onto many bicycles and motorcycles. For example, U.S. Pat. No. 3,657,753 discloses a folding inflatable surfboard comprised of two parts which, when assembled, provides some stiffness to the surfboard and the two parts can be separated and folded up for compact storage or transport.

While dealing with the problem of transport and storage, the performance of inflatable surfboards for competitive sport has generally not approached that of rigid one-piece boards. The ability to make sharp turns and reverses on a surfboard depends on being able to use actions by the surfboard rider to push a relatively sharp, hard bottom edge of the surfboard sharply into the water wave. However, inflatable surfboards by their nature generally have not had sharp or rigid edges that can serve this purpose well.

SUMMARY OF EMBODIMENTS OF THE INVENTION

Accordingly, it is a purpose of embodiments of the present invention to provide an apparatus which can be attached to inflatable surfboards to give those boards the type of hard edge which will improve their performance to approach that of rigid surfboards while retaining the ability to be deflated and rolled up for easy transport and storage. The apparatus comprises an elongated semi-rigid structure that can be attached to selected locations on an inflatable board by means of adhesives or other attachment mechanisms. The accompanying figures show some of the contemplated embodiments.

BRIEF DESCRIPTION OF DRAWINGS

The objects, advantages, features, and other desirable characteristics of embodiments of the invention can be readily perceived from the following detailed description when read in conjunction with the attached drawings, wherein.

DETAILED DESCRIPTION OF EMBODIMENTS OF THE INVENTION

All embodiments of the invention have the form of an elongated flexible structure, one surface of which conforms to the shape of the portion of the inflatable surfboard to which it is intended to be attached and the opposing surface of which is relatively rigid and has the shape of a hard edge designed to displace and cut through the water during surfing activity. The flexibility of the elongated structure is accomplished by selecting material and fabrication methods which enable the structure to be "wrapped" around and attached to the peripheral or side surface of the surfboard while maintaining a rigid edge or ridge which is parallel to the direction of elongation on the outer surface of the structure. By attaching this apparatus to the generally rounded edge surfaces of an inflatable surfboard, that surfboard is provided with a rigid hard edge which is generally like that provided on rigid surfboards by their manufacturer and which heretofore has not been available in inflatable surfboards. To maintain an overall streamlined structure which can easily slip through water with minimum friction and creation of water disturbance, in general the embodiments are provided with an overall structure which tapers from a portion containing the rigid hard edge to end portions which take the form of thin shells which conform to the shape of the sides of the surfboard. Each embodiment has sufficient flexibility to enable inflatable surfboards to be deflated and rolled up for storage or transport with the apparatus remaining in place and attached.

While particular embodiments of the present invention are disclosed herein, it is to be understood that various different modifications and combinations are possible and are contemplated within the true spirit and scope of the disclosed embodiments. There is no intention, therefore, of limitations to the exact disclosures herein presented.

This concept is contemplated to take a broad variety of specific embodiments and to be applicable to a broad variety of inflatable surfboards. While the apparatus is intended for use with inflatable surfboards, it may also be used on rigid surfboards to, in effect, replace the edge on those boards with one that can improve performance. In addition, the concept may also be used to improve the performance of stand-up paddleboards. These boards are, in essence, a version of a surfboard provided with features that enable a user to stand up on the board and use a paddle to propel it through the water. Embodiments of the current invention can be used with such stand-up paddleboards in a manner identical or very similar to their usage with surfboards of the traditional type. The term "surfboards" as used herein is intended to include all such boards.

Figure 1A:
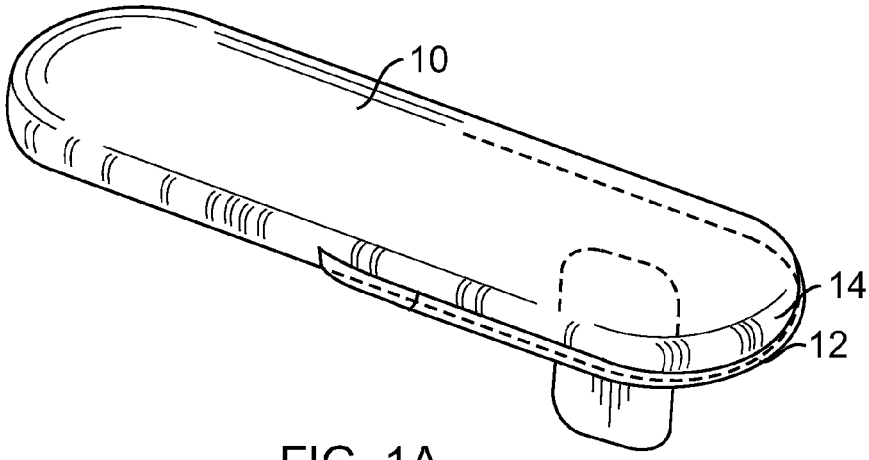
FIG. 1A is a perspective view of an inflatable surfboard with a hard edge apparatus attached in accordance with an embodiment of the invention.
Figure 1B:
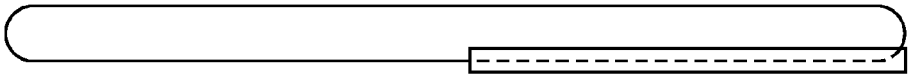
FIG. 1B is a side view of the surfboard with attached hard edge apparatus shown in FIG. 1A

FIGS. 1A and 1B illustrate an inflatable surfboard 10 with a preferred hard edge embodiment of the invention 12 attached to the rear portion 14 of the board. Inflatable surfboards that are suitable for attachment of the edge apparatus include those that are comprised of materials that will accept and secure the attachment using an appropriate attachment method. For example, the apparatus used in the preferred embodiment illustrated in FIG. 1A can be made from molded urethane material and is attached to an inflatable surfboard made from polyvinyl chloride (PVC) sheeting using a urethane-based adhesive.

As used herein, the term "hard edge" as applied to element 12 means that it maintains its edge shape in normal use. As contemplated here, element 12 is linearly flexible to enable the surfboard to be deflated and rolled or folded for storage, while it is comprised of material which is sufficiently stiff as to provide and maintain the edge required on the board in the region shown in FIG. 1A during the rolling and unrolling process. In some embodiments, the structure may be comprised of resilient materials, which enable the edge to deform during the process of deflating and rolling up the surfboard and to return its original form when the surfboard is unrolled and inflated.

Inflatable surfboards which are suitable for use with the embodiments disclosed herein include but are not limited to those made from polyurethane sheeting, PVC sheeting, neoprene sheeting, and other materials with sufficient flexibility and strength and ability to be bonded together to form the board using bonded joints which are strong enough to endure the forces and temperatures encountered in surfing. Suitable inflatable surfboards include those which are fabricated from a single sheet of material wrapped into the desired shape and sealed to itself using adhesives, those which are fabricated from two sheets of material forming the top and bottom surfaces, the edges being sealed to each other using adhesives or thermal bonding processes, and those which are fabricated from two sheets of material forming the top and bottom surfaces and with a separate sheet or sheet segments of material which form the side or peripheral edge of the surfboard and which are sealed to the top and bottom surfaces using adhesives or other methods. Inflatable surfboards that are fabricated using a combination of the above methods may also be suitable for use with the embodiments disclosed herein. While the benefits of the disclosed embodiments may be greatest for inflatable surfboards, they may also provide benefit when used with conventional surfboards fabricated from solid materials as well.

Figure 3A:
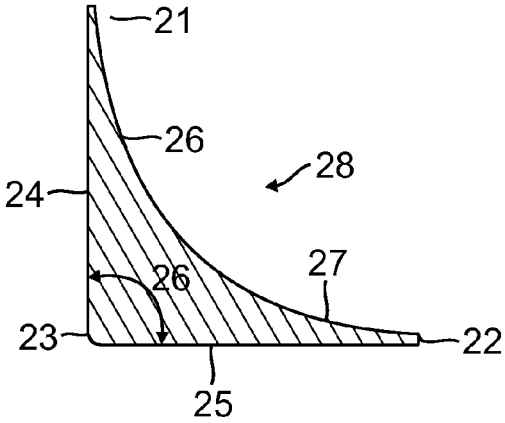
FIG. 3A is a cross section taken through cutting plane 3-3 in FIG. 2B.
Figure 3B:
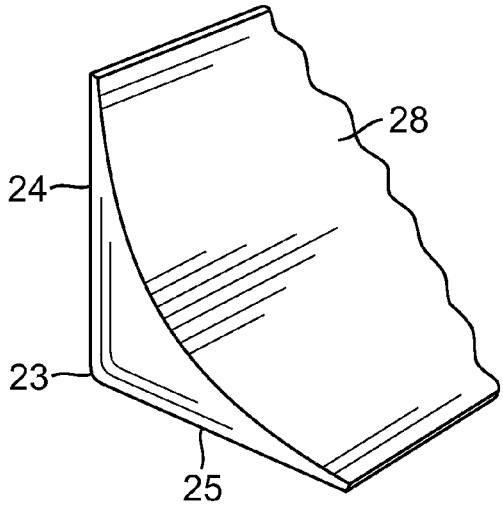
FIG. 3B is a perspective view of a segment of the apparatus of FIG. 2 adjacent to the FIG. 3A cross section.
Figure 4A:
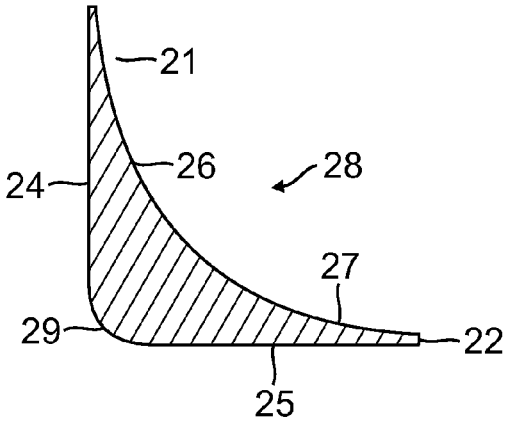
FIG. 4A is an alternative shape to the FIG. 3A cross section.
Figure 4B:
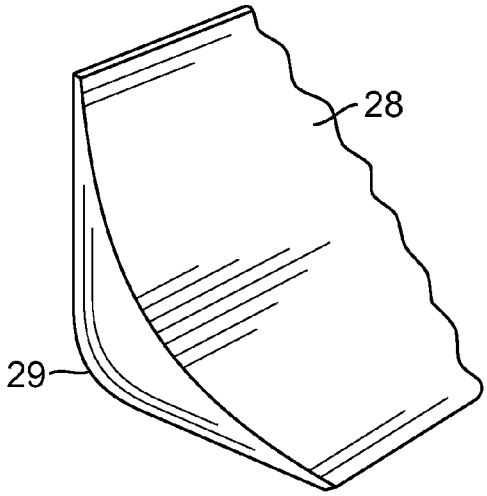
FIG. 4B is a perspective view of an adjacent segment, similar to FIG. 3B.

FIG. 2 shows the elongated flexible structure 12 that is a preferred embodiment of the hard edge apparatus in perspective, top, bottom, front, side, and end views. Shown in FIG. 2 are the locations of selected cross sections shown in detail in FIGS. 3 through 6, along with perspective views of adjacent segments of the elongated flexible structure. FIG. 3 shows the cross section of the embodiment indicated by 3-3 in FIG. 2. The cross section shows an L-shaped ridge structure with the two legs 21 and 22 of the "L" meeting at vertex 23. The angle at which the outer sides 24 and 25 of the legs meet is preferably about 90 degrees but effective hydrodynamic functionality may also be provided for vertex angles between about 60 degrees and about 120 degrees. Sides 26 and 27 of the legs which are opposite outer sides 24 and 25 meet to form a continuously curved surface 28, the shape of which substantially matches the shape of the portions of the inflatable surfboard to which the apparatus is to be attached. The continuously curved surface 28 thus forms a type of flange, which serves to provide a surface with sufficient area to enable a robust and durable attachment to the surfboard. Vertex 23 may be relatively sharp, as shown in FIG. 3A, or somewhat rounded, as vertex 29 in FIG. 4. The choice of angle can be determined based on hydrodynamic considerations in view of the surfing behavior desired by the user.

The cross section shown in FIG. 3 is maintained throughout that portion of the apparatus, which is attached to the rear of the surfboard and to segments extending a selected distance along each side of the surfboard adjacent to the rear, thus providing a rigid edge or ridge running parallel to the direction of elongation. The combined structure of inflatable surfboard plus attached apparatus thus provides rigid edge or ridge surfaces to the surfboard not otherwise available. This edge can be made very sharp which then provides superior hydrodynamic qualities which enable a user to corner more sharply in the water and thus to perform superior tricks and stunts. It also provides a superior ability to control boards in all types of water environments.

Figure 2A:
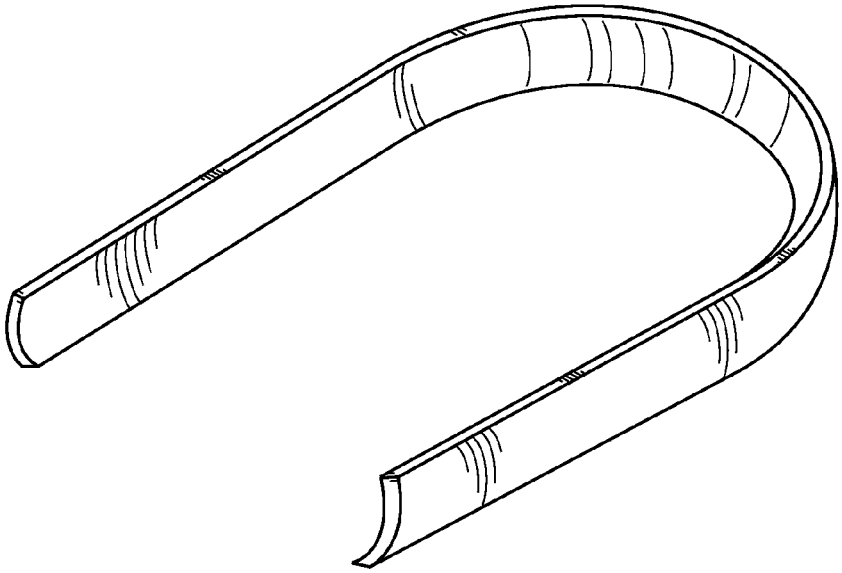
FIG. 2A is a perspective view of an embodiment of the hard edge apparatus shown in FIG. 1A.
Figure 2B:
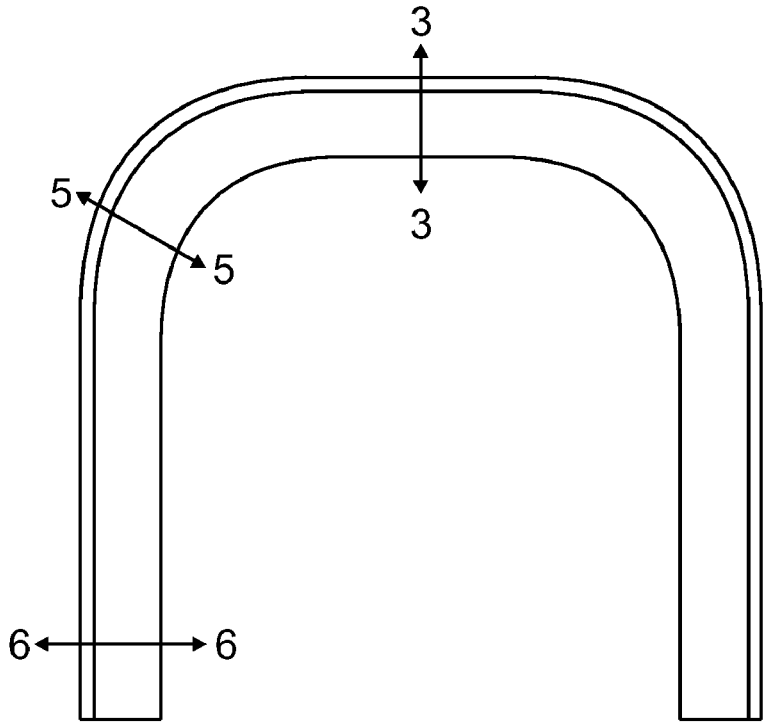
FIG. 2B is a top view of the apparatus of FIG. 2A.
Figure 2C:
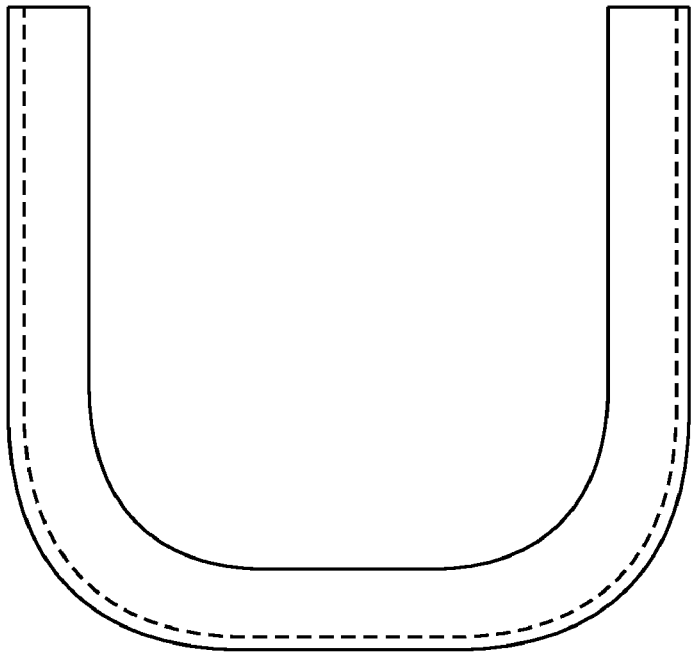
FIG. 2C is a bottom view of the apparatus of FIG. 2A.
Figure 2D:
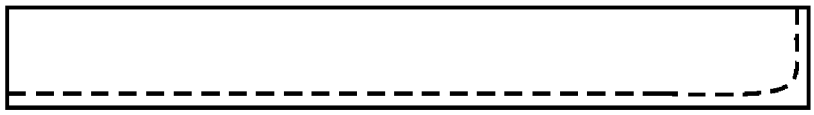
FIG. 2D is a side view of the apparatus of FIG. 2A.
Figure 2E:
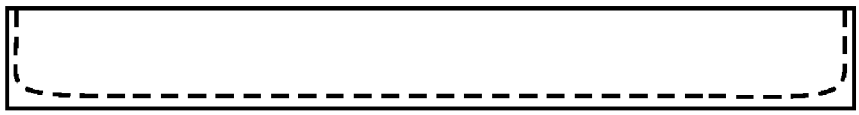
FIG. 2E is an end view of the apparatus of FIG. 2A.
Figure 5A:
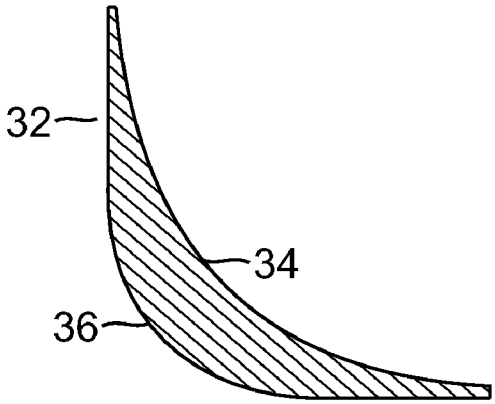
FIG. 5A is a cross section taken through cutting plane 5-5 in FIG. 2B.
Figure 5B:
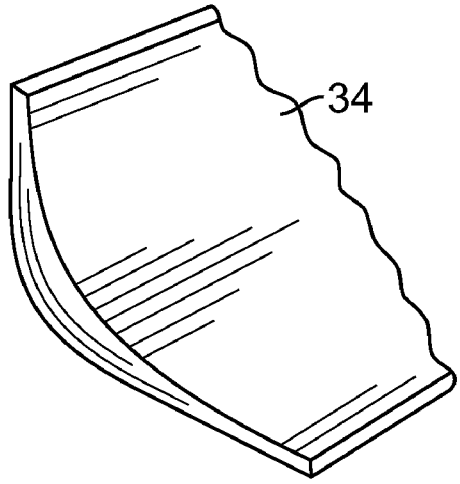
FIG. 5B is a perspective view of a segment of the apparatus of FIG. 2 adjacent to the FIG. 5A cross section.
Figure 6A:
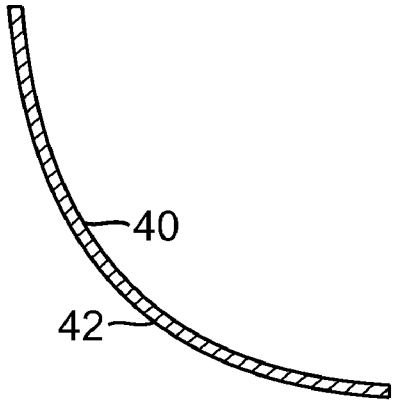
FIG. 6A is a cross section taken through cutting plane 6-6 in FIG. 2B.
Figure 6B:
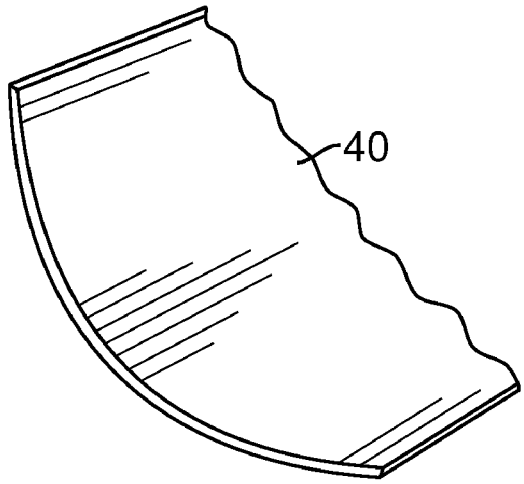
FIG. 6B is a perspective view of a segment of the apparatus of FIG. 2 adjacent to the FIG. 5A cross section.

Cross sections of the apparatus at other locations of the surfboard are indicated by 5-5 and 6-6 in FIG. 2B and are shown in FIGS. 5 and 6, respectively. FIG. 6 shows a cross section of the embodiment at a location towards an end of the apparatus, and a perspective view of an adjacent segment. Here the outer sides of the structure have a shape that is substantially the same as the shape of the structure inner surface, both of which are substantially matched to the shape of the portion of the peripheral edge of the surfboard at location 6-6. It is desirable to have the apparatus "merge" into the side of the surfboard in a smooth fashion to minimize turbulence that might be created in the water during surfing. FIG. 5 shows the cross-section at location 5-5 shown in FIG. 2B. At this location, the outer sides of the L-shaped structure have a shape between that shown in FIG. 3 and that shown in FIG. 6. The entire apparatus when attached to the peripheral surface of the surfboard using attachment means described below provides the surfboard with a hard edge over desired regions of the board and a gradual transition to a shell-like structure that conforms to the shape of a peripheral surface along the side of the board.

The length of the leg 21 is generally selected to be about one-half of the top surface to bottom surface thickness of the surfboard. Typically this may range from about 40 mm to about 100 mm although the selected value in each case will depend on the dimensions of the surfboard with which the apparatus will be used. The length of leg 22 can be generally comparable to that of leg 21, but the length of leg 22 may be chosen to be longer to increase the surface area used for attachment to the surfboard. A typical thickness of the apparatus between surfaces 40 and 42 (FIG. 6) ranges from about 1 mm to about 2 mm. However greater or lesser values for this parameter can be selected based on the material selected for use in fabricating the apparatus and the method of attachment selected.

Figure 7A:
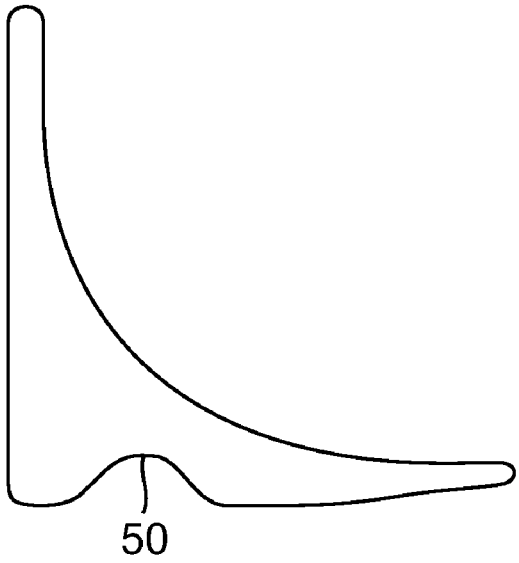
FIG. 7A shows an embodiment with a cross section having an alternative shape to that shown in FIG. 3A.
Figure 7B:
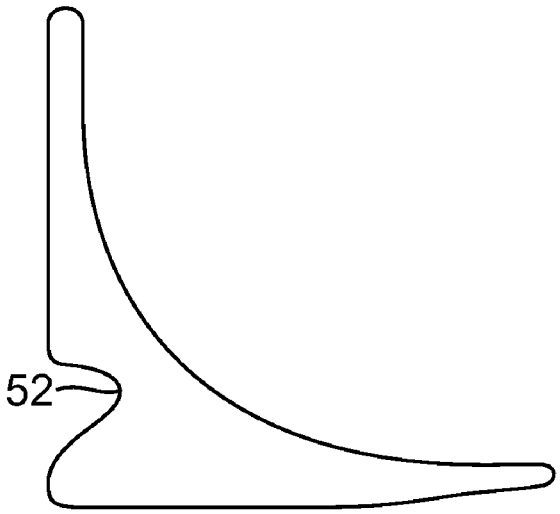
FIG. 7B is similar to FIG. 7A, with another alternative shape.

The embodiment shown in FIG. 2 is simple with generally flat outer surfaces forming the corners, the side surfaces 24 and 25 forming an angle of about 90 degrees with each other and is a preferred embodiment for the arrangement shown in FIG. 1. However, embodiments with alternative designs are contemplated based on hydrodynamic factors that can further enhance the performance. For example, the angle between flat surfaces 24 and 25 may be greater or less than 90 degrees as preferred by the user of the surfboard, the preferable range being between about 60 and about 120 degrees. FIG. 7 shows two possible alternative cross sections that incorporate a groove 50 or a groove 52, or both, into the side or bottom of the apparatus for improved hydrodynamics. It is expected that other variations on the basic design will be adopted based on experimental evidence gathered through employment of the initial embodiments in surfing activity. It is also expected that the variation of the thickness and stiffness of the hard edge apparatus along the length and around the rear of the surfboard will also be selected to optimize performance. For example, adding sections with a profile like that shown in FIG. 3 along the sides of an inflatable board may add stability in certain water and wave conditions. The disclosure of the embodiment of the hard edge attachment made herein and the specific embodiments described herein are intended to include all variations in cross-section design and in thickness distribution along the length of the apparatus and around the periphery of the surfboard to which the apparatus is attached.

To summarize the preferred embodiment illustrated in FIGS. 3-6, the portion of the apparatus which has the profile shown in FIG. 3 provides sharp edge surfaces which cut into the water when the surfboard is in use. As noted above, the portions of the apparatus that have this profile are located on those portions of the periphery of the surfboard where such hydrodynamic functionality is desired. However, to minimize the creation of eddy currents and other disruption of the water, the apparatus is tapered to gradually transition from the regions with the profile shown in FIG. 3 to those shown in FIG. 5 and FIG. 6, wherein the apparatus shape closely matches the shape of the peripheral surface of the surfboard itself. This provides a greater surface area for attachment of the apparatus to the surfboard while maintaining an overall streamlined design.

Materials, which are suitable for fabrication of the preferred embodiment include, but are not limited to, urethane, hard rubber, semi-rigid composite material such as a fiberglass, semi-rigid vinyl, EVA foam (expanded rubber foam), polyvinyl chloride (PVC), and neoprene. The choice of material for the apparatus is made based on durability, flexibility, stiffness, weight, manufacturing cost, and availability, and cost of methods of attachment suitable for attaching the apparatus to the surfboard in view of the material making up the surfboard. In particular, the trade-off between weight and durability may be made based on the demand for high performance. For example, in competitive surfing acrobatics, lighter weight of the surfboard can be an important factor overriding considerations of the useful lifetime of the board. Methods of fabricating the preferred embodiment can include extrusion, extrusion in sections, injection molding into suitable molds, and lamination of thin cut layers to form the final shape.

The apparatus can be attached to an inflatable surfboard at various locations determined by the type of surfing performance enhancement desired. A commonly preferred location is expected to be across the lower portion of the rear end of the board extending along the lower portion of the sides of the board from the rear end of the board part way toward the nose. Typical inflatable surfboards have lengths when inflated ranging from 5 to 14 feet. A preferred embodiment has the hard edge run across the rear end of the board and along both sides for a distance of about one third of the entire length of the board. However, embodiments in which the hard edge extends farther or lesser distances along the length of the board are also contemplated.

Figure 8:
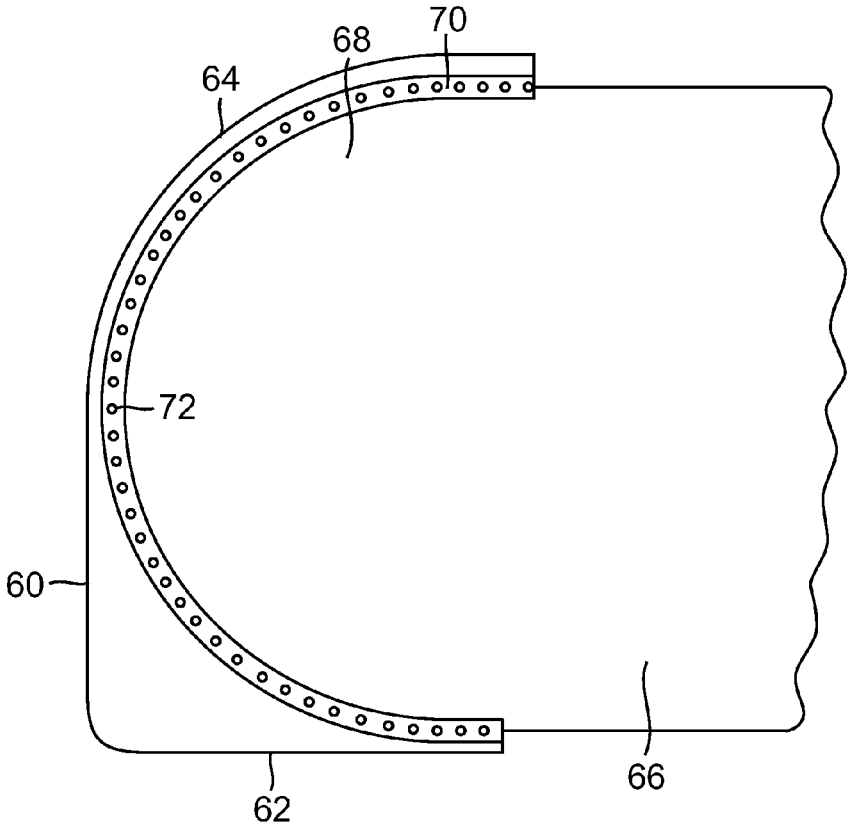
FIG. 8 is a partial sectional view of another embodiment of the apparatus attached to a surfboard with adhesive.

Another embodiment contemplated is illustrated in cross section in FIG. 8. The location of this cross section corresponds to that of the cross section discussed in the embodiment shown in FIG. 2B. In this embodiment, L-shaped arm 60 that engages the side of surfboard 66 includes extension 64 to wrap around upper edge 68 of the board and over a portion of upper surface 70 of the board. This embodiment allows a greater surface area for attachment and will thus increase the durability and strength of that attachment.

For each of the embodiments discussed above, the hard edge apparatus is attached to the inflatable surfboard using an appropriate method of attachment. Methods for attachment are selected based on the materials making up to the items to be joined. The method of fixation must offer both strength and flexibility in view of the flexure to which the surfboard with the attached apparatus will be subjected, not only when in use for surfing but also when being rolled up for storage or transport. The method of fixation must also remain strong and flexible when exposed to ocean water and to a wide range of temperatures to which the surfboard will be subjected during surfing activity. Such methods of attachment include, but are not limited to, urethane adhesives, epoxies with resin content producing a flexible bonding joint, rubber cement, silicone adhesive, and adhesives which are applied and set up at elevated temperatures.

Figure 9A:
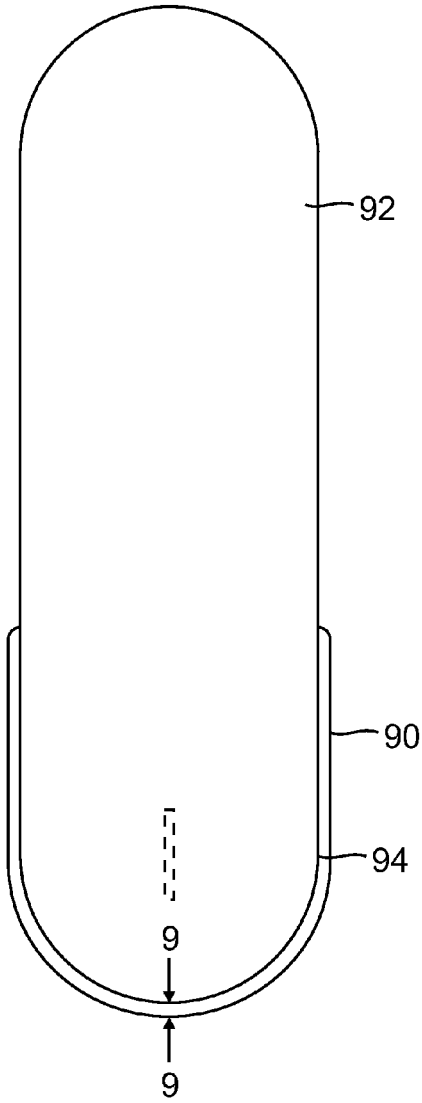
FIG. 9A is a top schematic view of the apparatus of FIG. 2 attached to a surfboard.
Figure 9B:
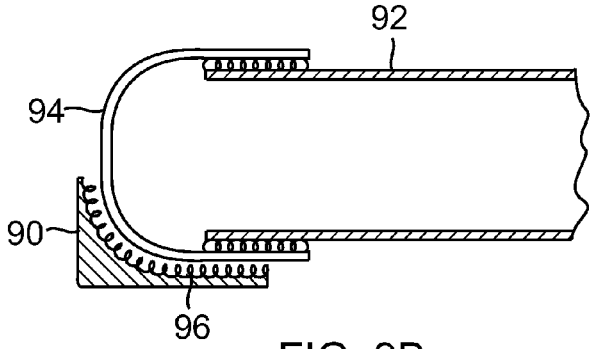
FIG. 9B is a partial sectional view taken through cutting plane 9-9 of FIG. 9A.

FIG. 8 shows the attachment 72 of the hard edge embodiment described above to the inflatable surfboard using one of these materials. FIGS. 9A and 9B illustrate the attachment of a preferred embodiment 90 of the type shown in FIGS. 3 through 6 to inflatable surfboard 92 in which the apparatus is attached to the lower rear portion of peripheral edge 94 of the board with adhesive 96.

Figure 10A:
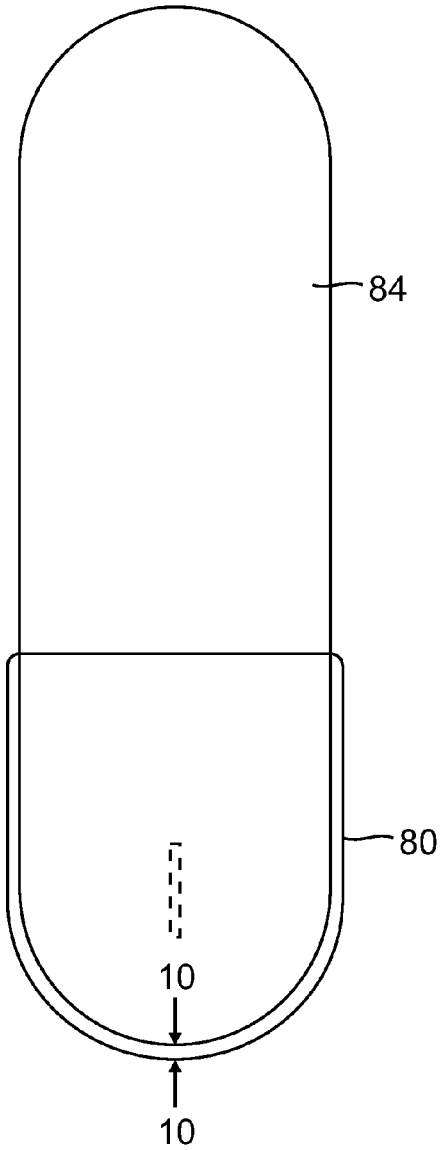
FIG. 10A is a top view, similar to FIG. 9A, of an alternative embodiment.
Figure 10B:
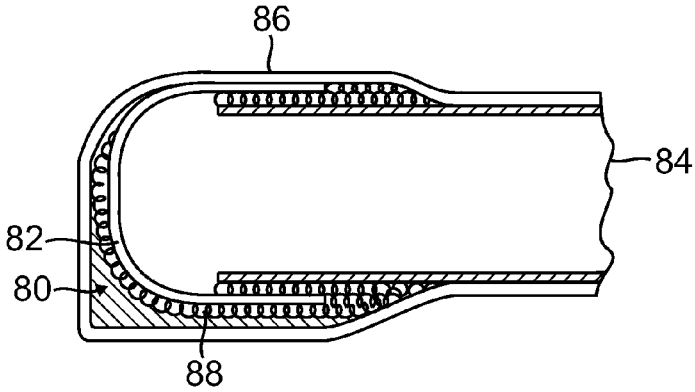
FIG. 10B is a partial sectional view, similar to FIG. 9B, taken through cutting plane 10-10 of FIG. 10A.

Another embodiment contemplated is shown in FIG. 10. In this embodiment, hard edge apparatus 80 is laminated to lower peripheral edge 82 of board 84 by adding a layer of sheeting 86 over the apparatus and a portion of the entire outer surface of the board and affixing the added layer to the board and apparatus using adhesive 88.

Similar methods of attachment can be used when attaching a hard edge apparatus to a rigid surfboard. But in this case, the demands for flexibility of the finished joint are less severe since the joint will not be subject to the same range of flexure as on inflatable boards.

A further method of attachment that is contemplated is to make the hard edge apparatus removable. In this embodiment, the apparatus is removably attached to the inflatable or rigid surfboard before use and removed after use for transport or storage. One suitable method of removable attachment is the employment of hook-and-loop fastener strips, or snaps. Another method of attachment which makes the hard edge apparatus removable is to affix a strip along the back and side edges of an inflatable surfboard, the strip being provided with a keyway having a T-shape or similar keyway cross-sectional shape. A hard edge apparatus such as those described above is then provided along its entire length with a mating T-shaped or key structure matched to the shape of the keyway. To attach the hard edge apparatus to the board, the T-shaped structure of the apparatus is inserted into one end of and through the keyway until the entire length of the apparatus is coupled to the strip and thus to the surfboard itself.

Testing of a prototype similar to the embodiment shown in FIG. 3 has demonstrated a remarkable improvement not only in maneuverability of the board but also of the speed of the board over the ocean waves. The sharp ridge or edge provided by the attached apparatus enables improved maneuverability and the smooth flat surface it provides increases speed through the water owing to improved hydrodynamics.

Once again it should be noted that particular embodiments of the present invention are being disclosed herein. But it should be understood that various modifications and combinations of the specific embodiments disclosed are possible and are contemplated. There is no intention to limit the claims to the exact disclosures herein presented.

What is claimed is:

1. An apparatus for enhancing the performance of a surfboard, the surfboard having a top surface, a bottom surface, and a peripheral surface situated between the top surface and the bottom surface, each surface having a topographic shape, the surfboard further having a back end, a front end, and two sides situated between the front end and the back end, the apparatus comprising:

an elongated flexible structure a main portion of which has a generally uniform L-shaped cross section with two legs meeting each other at a vertex, each leg having an leg inner surface and a leg outer surface, the leg outer surfaces meeting each other at the vertex at an angle, the leg inner surfaces meeting each other to form a main structure inner surface, the main structure inner surface having a topographic shape which is complementary to the topographic shape of a portion of the peripheral surface of the surfboard and a portion of the bottom surface of the surfboard adjacent to the portion of the peripheral surface; and means for attaching the main structure inner surface to the portion of the peripheral surface and the portion of the bottom surface of the surfboard;

the elongated flexible structure further comprising:

a second portion having a second portion inner surface and a second portion outer surface which is parallel to the second portion inner surface, the second portion inner surface having a topographic shape which is complementary to the topographic shape of a second portion of the peripheral surface and a second portion of the bottom surface adjacent to the second portion of the peripheral surface;

a connection portion connecting the second portion of the elongated flexible structure to the first portion; and means for attaching the second portion and the connecting portion to at least one of the peripheral surface, the bottom surface, and the top surface of the surfboard;

wherein at least one of the means for attaching the main structure inner surface to the portion of the peripheral surface and the portion of the bottom surface of the surfboard and the means for attaching the second portion and the connecting portion to at least one of the peripheral surface, the bottom surface, and the top surface of the surfboard utilizes at least one material selected from the group consisting of urethane adhesives, epoxies with resin content producing a flexible bonding joint, rubber cement, silicone adhesive, and adhesives which are applied and set up at temperatures higher than an ambient temperature.

2. The apparatus of claim 1, wherein the angle at which the two leg outer surfaces meet each other at the vertex is at a substantially right angle.

3. The apparatus of claim 1, wherein the angle at which the two leg outer surfaces meet each other at the vertex is an angle between about 60 degrees and about 120 degrees.

4. The apparatus of claim 1, wherein the elongated flexible structure is fabricated from materials selected from the group consisting of urethane, hard rubber, semi-rigid composite material, semi-rigid vinyl, expanded rubber foam, and polyvinyl chloride.

5. The apparatus of claim 1, wherein at least one of the two legs is provided with at least one groove, each groove having size and shape selected to change the hydrodynamic flow of water past the apparatus.

6. An apparatus for enhancing the performance of a surfboard, the surfboard having a top surface, a bottom surface, and a peripheral surface situated between the top surface and the bottom surface, each surface having a topographic shape, the surfboard further having a back end, a front end, and two sides situated between the front end and the back end, the apparatus comprising:

an elongated flexible structure a main portion of which has a generally uniform L-shaped cross section with two legs meeting each other at a vertex, each leg having an leg inner surface and a leg outer surface, the leg outer surfaces meeting each other at the vertex at an angle, the leg inner surfaces meeting each other to form a main structure inner surface, the main structure inner surface having a topographic shape which is complementary to the topographic shape of a portion of the peripheral surface of the surfboard and a portion of the bottom surface of the surfboard adjacent to the portion of the peripheral surface; and means for attaching the main structure inner surface to the portion of the peripheral surface and the portion of the bottom surface of the surfboard;

the elongated flexible structure further comprising:

a second portion having a second portion inner surface and a second portion outer surface which is parallel to the second portion inner surface, the second portion inner surface having a topographic shape which is complementary to the topographic shape of a second portion of the peripheral surface and a second portion of the bottom surface adjacent to the second portion of the peripheral surface;

a connection portion connecting the second portion of the elongated flexible structure to the first portion; and means for attaching the second portion and the connecting portion to at least one of the peripheral surface, the bottom surface, and the top surface of the surfboard;

wherein at least one of the means for attaching the main structure inner surface to the portion of the peripheral surface and the portion of the bottom surface of the surfboard and the means for attaching the second portion and the connecting portion to at least one of the peripheral surface, the bottom surface, and the top surface of the surfboard is a flexible enclosure that surrounds the apparatus and portions of the surfaces of the surfboard, the flexible enclosure being attached to the surfboard.

7. The apparatus of claim 6 wherein the angle at which the two leg outer surfaces meet each other at the vertex is a substantially right angle.

8. The apparatus of claim 6, wherein the angle at which the two leg outer surfaces meet each other at the vertex is an angle between about 60 degrees and about 120 degrees.

9. The apparatus of claim 6, wherein the elongated flexible structure is fabricated from materials selected from the group consisting of urethane, hard rubber, semi-rigid composite material, semi-rigid vinyl, expanded rubber foam, and polyvinyl chloride.

10. The apparatus of claim 6, wherein at least one of the two legs is provided with at least one groove, each groove having size and shape selected to change the hydrodynamic flow of water past the apparatus.

11. An apparatus for surfing on water, the apparatus comprising:

a surfboard having a top surface, a bottom surface, and a peripheral surface situated between the top surface and the bottom surface, each surface having a topographic shape, the surfboard further having a back end, a front end, and two sides situated between the front end and the back end;

an elongated flexible structure a main portion of which has a generally uniform L-shaped cross section with two legs meeting each other at a vertex, each leg having an leg inner surface and a leg outer surface, the leg outer surfaces meeting each other at the vertex at an angle, the leg inner surfaces meeting each other to form a main structure inner surface, the main structure inner surface having a topographic shape which is complementary to the topographic shape of a portion of the peripheral surface of the surfboard and a portion of the bottom surface of the surfboard adjacent to the portion of the peripheral surface; and means for attaching the main structure inner surface to the portion of the peripheral surface and the portion of the bottom surface of the surfboard in a location and with an orientation wherein the vertex displaces the water on which the surfboard is floating;

the elongated flexible structure further comprising:

a second portion having a second portion inner surface and a second portion outer surface which is parallel to the second portion inner surface, the second portion inner surface having a topographic shape which is complementary to the topographic shape of a second portion of the peripheral surface and a the topographic shape of a second portion of the bottom surface adjacent to the second portion of the peripheral surface;

a connection portion connecting the second portion of the elongated flexible structure to the first portion; and means for attaching the second portion and the connecting portion to at least one of the peripheral surface, the bottom surface, and the top surface of the surfboard;

wherein at least one of the means for attaching the main structure inner surface to the portion of the peripheral surface and the portion of the bottom surface of the surfboard and the means for attaching the second portion and the connecting portion to at least one of the peripheral surface, the bottom surface, and the top surface of the surfboard utilizes at least one material is selected from the group consisting of urethane adhesives, epoxies with resin content producing a flexible bonding joint, rubber cement, silicone adhesive, and adhesives which are applied and set up at elevated temperatures greater than an ambient temperature.

12. The apparatus of claim 11, wherein the surfboard is an inflatable surfboard.

13. An apparatus for surfing on water, the apparatus comprising:

a surfboard having a top surface, a bottom surface, and a peripheral surface situated between the top surface and the bottom surface, each surface having a topographic shape, the surfboard further having a back end, a front end, and two sides situated between the front end and the back end;

an elongated flexible structure a main portion of which has a generally uniform L-shaped cross section with two legs meeting each other at a vertex, each leg having an leg inner surface and a leg outer surface, the leg outer surfaces meeting each other at the vertex at an angle, the leg inner surfaces meeting each other to form a main structure inner surface, the main structure inner surface having a topographic shape which is complementary to the topographic shape of a portion of the peripheral surface of the surfboard and a portion of the bottom surface of the surfboard adjacent to the portion of the peripheral surface; and means for attaching the main structure inner surface to the portion of the peripheral surface and the portion of the bottom surface of the surfboard in a location and with an orientation wherein the vertex displaces the water on which the surfboard is floating;

the elongated flexible structure further comprising:

a second portion having a second portion inner surface and a second portion outer surface which is parallel to the second portion inner surface, the second portion inner surface having a topographic shape which is complementary to the topographic shape of a second portion of the peripheral surface and the topographic shape of a second portion of the bottom surface adjacent to the second portion of the peripheral surface;

a connection portion connecting the second portion of the elongated flexible structure to the first portion; and means for attaching the second portion and the connecting portion to at least one of the peripheral surface, the bottom surface, and the top surface of the surfboard;

wherein at least one of the means for attaching the main structure inner surface to the portion of the peripheral surface and the portion of the bottom surface of the surfboard and the means for attaching the second portion and the connecting portion to at least one of the peripheral surface, the bottom surface, and the top surface of the surfboard is a flexible enclosure that surrounds the apparatus and portions of the surfaces of the surfboard, the flexible enclosure being attached to the surfboard.

14. The apparatus of claim 13, wherein the surfboard is an inflatable surfboard.

* * * * *